US008118332B2

(12) United States Patent
Morgan et al.

(10) Patent No.: US 8,118,332 B2
(45) Date of Patent: Feb. 21, 2012

(54) LATCH DEVICE

(75) Inventors: Karl S. Morgan, Des Plaines, IL (US); Robert Dam, Aurora, IL (US); Mike Davis, Elburn, IL (US)

(73) Assignee: Illinois Tool Works Inc., Glenview, IL (US)

( * ) Notice: Subject to any disclaimer, the term of this patent is extended or adjusted under 35 U.S.C. 154(b) by 300 days.

(21) Appl. No.: 12/403,488

(22) Filed: Mar. 13, 2009

(65) Prior Publication Data

US 2009/0260198 A1 Oct. 22, 2009

Related U.S. Application Data

(60) Provisional application No. 61/045,681, filed on Apr. 17, 2008.

(51) Int. Cl.
*E05C 19/06* (2006.01)
*E05B 15/02* (2006.01)

(52) U.S. Cl. ..... 292/17; 292/341.11; 292/DIG. 69

(58) Field of Classification Search ..... 292/17–20, 292/70, 76, 249, 340, 77, 80, 83, 84, 87, 292/88, 91, 95, 107, 125, 152, 180, 209, 292/303, 341, 341.11, DIG. 11, DIG. 16, 292/DIG. 56, DIG. 57, DIG. 59, DIG. 61, 292/DIG. 65, DIG. 66, DIG. 69, DIG. 73, 292/341.12, 341.13; 24/459, 618; 16/86 A–86 C, 16/85, 86 R See application file for complete search history.

(56) References Cited

U.S. PATENT DOCUMENTS 1,089,193 A * 3/1914 Ervien ..... 292/15
1,098,393 A * 6/1914 O'Brien ..... 16/86 B
1,400,482 A * 12/1921 Ewing ..... 49/436
1,620,414 A * 3/1927 Vanderlip ..... 292/101
1,664,174 A * 3/1928 Hoopes, Jr. ..... 292/344
1,688,095 A * 10/1928 Stutson ..... 16/86 B
1,830,716 A * 11/1931 Pripusich ..... 16/86 B
2,169,691 A * 8/1939 Hammer ..... 292/17
2,511,998 A 6/1950 Rummelsburg ..... 292/17
2,749,163 A * 6/1956 Loeb ..... 292/17
2,837,361 A * 6/1958 Loeb ..... 292/15

(Continued)

FOREIGN PATENT DOCUMENTS

GB 875719 8/1961

(Continued)

OTHER PUBLICATIONS

International Search Report and Written Opinoin for PCT/US2009/039598.

*Primary Examiner* — Carlos Lugo
*Assistant Examiner* — Alyson M Merlino
(74) *Attorney, Agent, or Firm* — Mark W. Croll; Paul F. Donovan

(57) ABSTRACT

A latch device including a latch strike retention assembly adapted for press-fit insertion into a panel opening and retention within the panel opening upon melting of any plastic components. The latch strike retention assembly includes a generally "U" shaped spring member having spring legs operatively connected to bushings arranged in converging opposing relation to one another and adapted to engage and retain a strike member disposed in opposing relation to the strike retention assembly. The spring member is held within a bracket member of substantially "U" shaped cross section. The bracket member is disposed in transverse orientation to the spring member.

17 Claims, 5 Drawing Sheets

U.S. PATENT DOCUMENTS

| | | | | | |
|---|---|---|---|---|---|
| 2,946,612 | A | * | 7/1960 | Ahlgren | 292/17 |
| 3,038,747 | A | * | 6/1962 | Rapata | 292/17 |
| 3,103,378 | A | * | 9/1963 | Ahlgren | 292/17 |
| 3,520,568 | A | * | 7/1970 | White et al. | 292/255 |
| 3,780,904 | A | * | 12/1973 | Stanford | 220/316 |
| 3,941,965 | A | * | 3/1976 | Piber | 200/296 |
| 4,272,111 | A | | 6/1981 | Hammer, Jr. et al. | 292/17 |
| 5,243,771 | A | * | 9/1993 | Kretchman et al. | 34/108 |
| 5,377,662 | A | * | 1/1995 | Mills et al. | 126/110 R |
| 7,380,846 | B1 | * | 6/2008 | Moreno | 292/259 R |

FOREIGN PATENT DOCUMENTS

| | | |
|---|---|---|
| GB | 971786 | 10/1964 |

* cited by examiner

LATCH DEVICE

CROSS-REFERENCE TO RELATED APPLICATIONS

This application claims the benefit of, and priority from, U.S. Provisional Application 61/045,681 filed Apr. 17, 2008, the contents of which are incorporated herein by reference in their entirety.

TECHNICAL FIELD

The present invention relates generally to latches, and, more particularly, to latches used in containment structures and appliances such as dryers and the like to hold a containment door in closed position relative to a containment cabinet.

BACKGROUND OF THE INVENTION

In many containment structures including appliances such as dryers and the like, a door may be held in a closed position by a latching assembly incorporating a retainer in combination with a latch pin or strike. The retainer is typically snapped into a punched out hole in the door and the strike is positioned in opposing relation within the associated cabinet. Once the door is closed, the head of the strike is trapped within the retainer until an opening force is applied to the door by a user.

One potentially desirable feature of a latch assembly for use in a container is the ability to maintain the door in a closed position under enhanced temperature conditions that may melt plastic components within the latch assembly. Thus, in the event of a fire at the interior of the container, the door will remain closed thereby confining the fire at the interior. Such a feature may be particularly useful in a clothes dryer or other container intended to operate under enhanced temperature conditions.

One exemplary prior latch assembly that maintains the door of a clothes dryer in a closed position during an abnormally elevated temperature event is disclosed in U.S. Pat. No. 4,272,111 to Hammer, Jr. et al., the contents of which are hereby incorporated by reference in their entirety as if fully set forth herein. In the latch device of Hammer, Jr., a metal spring of substantially "U" shaped cross-section engages lateral sides of a plastic anchor member on opposing sides of a crevice opening within the anchor member. The spring includes outwardly projecting sheared leg members that are pushed through the access opening within the dryer door and which thereafter block removal. During a high temperature event that melts the plastic anchor member, the metal spring remains substantially intact in secure relation about a cooperating strike element with the outwardly projecting leg members holding the latch assembly in place.

While the device described in U.S. Pat. No. 4,272,111 operates in a satisfactory manner, the inclusion of the blocking legs as part of the spring necessitates a relatively high insertion force when the latch assembly is originally installed. Moreover, during normal operation the legs of the spring are caused to flex inwardly and outwardly as the strike is engaged and disengaged relative to the plastic anchor member. Thus, the blocking legs projecting from the spring may experience corresponding movement and a resultant degree of wear over time.

SUMMARY OF THE INVENTION

The present invention provides advantages and alternatives relative to prior known latch assemblies by providing a latch device including a latch strike retention assembly adapted for press-fit insertion into a panel opening and retention within the panel opening upon melting of any plastic components. The latch strike retention assembly includes a generally "U" shaped spring member having spring legs operatively connected to bushings arranged in converging opposing relation to one another and adapted to engage and retain a strike member disposed in opposing relation to the strike retention assembly. The spring member is held within a bracket member of substantially "U" shaped cross section. The bracket member is disposed in transverse orientation to the spring member.

According to one exemplary aspect, the present invention provides a latch strike retention assembly adapted to accept and retain a latch strike. The latch strike retention assembly includes a bracket member of substantially "U" shaped profile adapted for retention within a panel opening. The bracket member includes a bracket base and a pair of substantially opposing bracket legs extending away from the bracket base. An anchor latch is disposed at the interior of the bracket member, the anchor latch includes a substantially "U" shaped spring member. The spring member includes a first spring leg extending away from a spring base and at least a second spring leg extending away from the spring base. The first spring leg operatively engages a first bushing structure and the second spring leg operatively engages a second bushing structure. The first bushing structure and the second bushing structure are disposed in opposing relation to one another and cooperatively define a strike acceptance crevice having a length dimension extending between the first bushing structure and the second bushing structure. The anchor latch is secured at an interior portion of the bracket member with the spring member oriented transverse to the bracket member with the length dimension of the strike acceptance crevice oriented transverse to the bracket legs.

According to another exemplary aspect, the present invention provides a latch strike retention assembly adapted to accept and retain a latch strike. The latch strike retention assembly includes a bracket member of substantially "U" shaped profile adapted for retention within a panel opening. The bracket member includes a bracket base, a first bracket leg extending away from the bracket base and a second bracket leg extending away from the bracket base. An anchor latch is disposed at the interior of the bracket member. The anchor latch includes a substantially "U" shaped spring member, the spring member includes a first spring leg extending away from a spring base and at least a second spring leg extending away from the spring base. The first spring leg operatively engages a first bushing structure and the second spring leg operatively engages a second bushing structure. The first bushing structure and the second bushing structure are disposed in opposing relation to one another and cooperatively define a strike acceptance crevice having a length dimension extending between the first bushing structure and the second bushing structure. At least the first bushing structure includes a first plurality of bushing elements cooperatively surrounding a terminal end of the first spring leg. The anchor latch is secured at an interior portion of the bracket member with the spring member oriented transverse to the bracket member with the spring legs oriented between the bracket legs and with the length dimension of the strike acceptance crevice oriented transverse to the bracket legs.

According to yet another exemplary aspect, the present invention provides a latch strike retention assembly adapted to accept and retain a latch strike. The latch strike retention assembly includes a metallic bracket member of substantially "U" shaped profile adapted for retention within a panel opening. The bracket member includes a bracket base, a first bracket leg extending away from the bracket base and a second bracket leg extending away from the bracket base. The first bracket leg includes a first outwardly flared distal end and the second bracket leg includes a second outwardly flared distal end. The first bracket leg includes a first inwardly extending resilient spring retention tab projecting in upwardly angled relation away from the first bracket leg generally towards the bracket base and a first outwardly extending resilient locking tab projecting in downwardly angled relation away from the first bracket leg generally towards the first outwardly flared distal end. The second bracket leg includes a second inwardly extending resilient spring retention tab projecting in upwardly angled relation away from the second bracket leg generally towards the bracket base and a second outwardly extending resilient locking tab projecting in downwardly angled relation away from the second bracket leg generally towards the second outwardly flared distal end. An anchor latch is disposed at the interior of the bracket member. The anchor latch includes a substantially "U" shaped spring member. The spring member includes a first spring leg extending away from a spring base and at least a second spring leg extending away from the spring base. The first spring leg operatively engages a first bushing structure and the second spring leg operatively engages a second bushing structure. The first bushing structure and the second bushing structure are disposed in opposing relation to one another and cooperatively defining a strike acceptance crevice having a length dimension extending between the first bushing structure and the second bushing structure. The anchor latch is secured adjacent an interior surface of the bracket base with the spring base held between the bracket base and the first and second spring retention tabs. The spring member is oriented transverse to the bracket member with the spring legs oriented between the bracket legs and with the length dimension of the strike acceptance crevice oriented transverse to the bracket legs.

Figure 1:
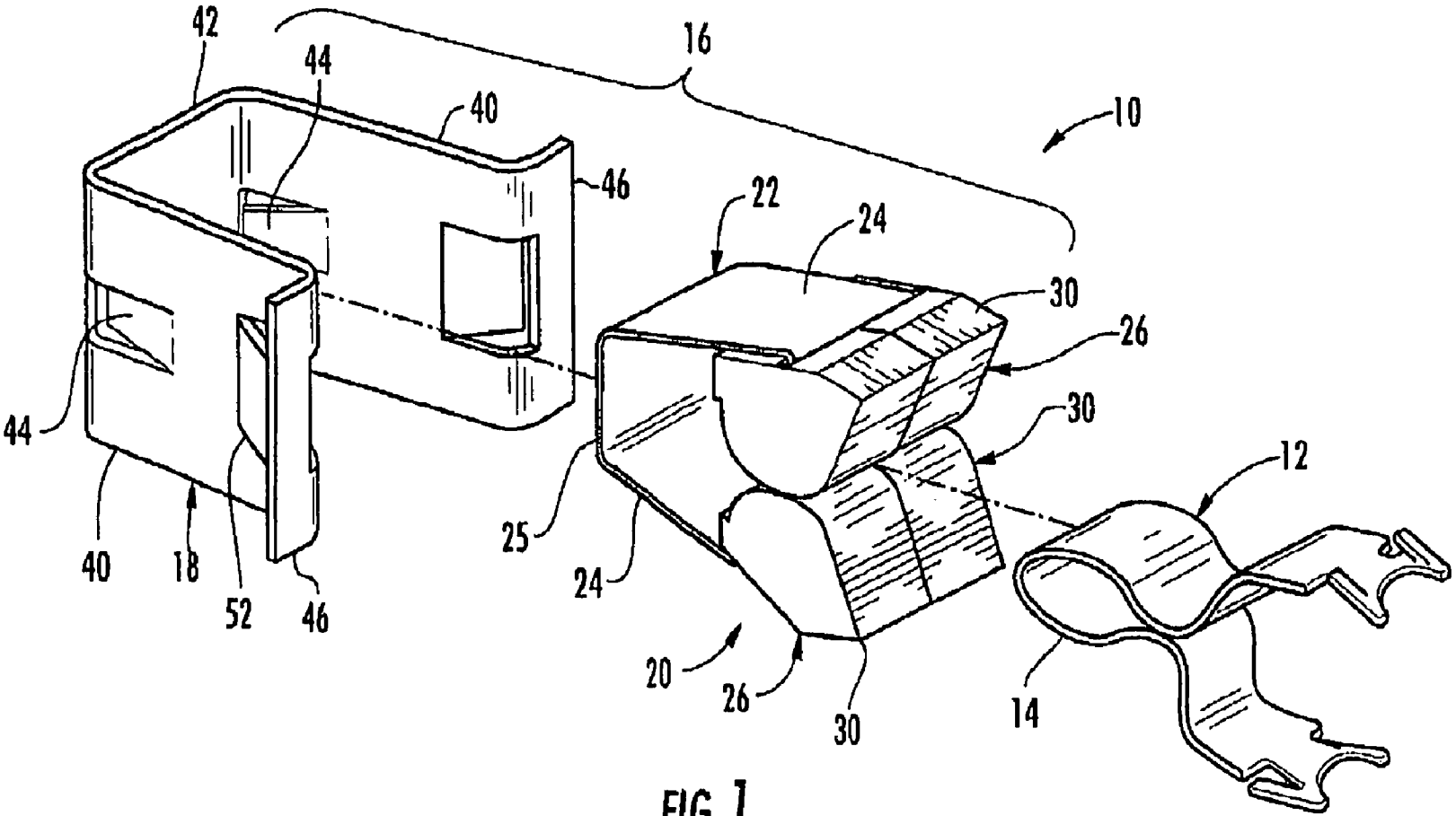
FIG. 1 is an exploded view of an exemplary latch device in accordance with the present invention.

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION OF THE PREFERRED EMBODIMENTS

Reference will now be made to the drawings, wherein like reference numerals are utilized to designate like elements in the various views. FIG. 1 is an exploded perspective view of a latch assembly 10. As shown, the latch assembly 10 includes a strike 12 which may be held in secure relation within a first structure such as an appliance cabinet or the like (not shown). The strike 12 includes a bulbous head portion 14 adapted to project outwardly away from the structure supporting the strike 12. The latch assembly 10 further includes a strike retention assembly 16 as illustrated in FIGS. 1 and 3, incorporating a bracket member 18 and a spring-biased anchor latch 20. As may be seen through joint reference to FIGS. 1, 2, and 3, the anchor latch 20 is held in substantially nested relation at the interior of the bracket member 18 upon final assembly to form the strike retention assembly 16. The strike retention assembly 16 is normally housed within a door panel or other support structure in opposing relation to the strike 12.

Figure 2:
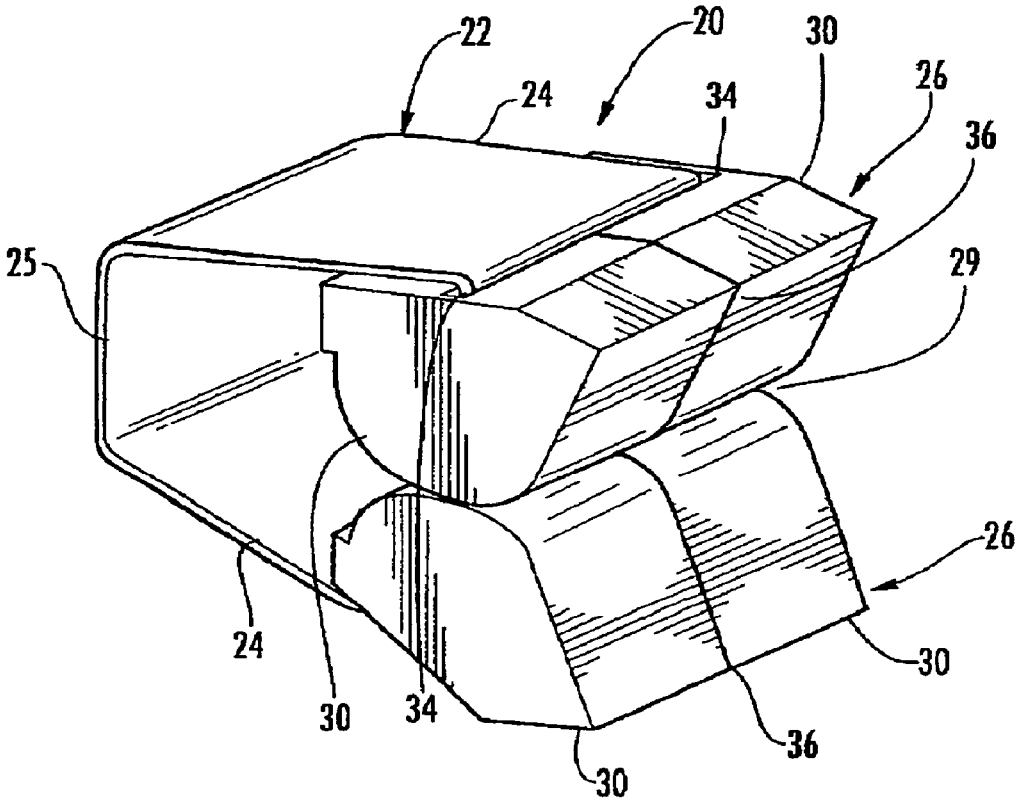
FIG. 2 is a perspective view illustrating an exemplary spring-biased anchor latch subassembly for use within the latch device of FIG. 1.
Figure 3:
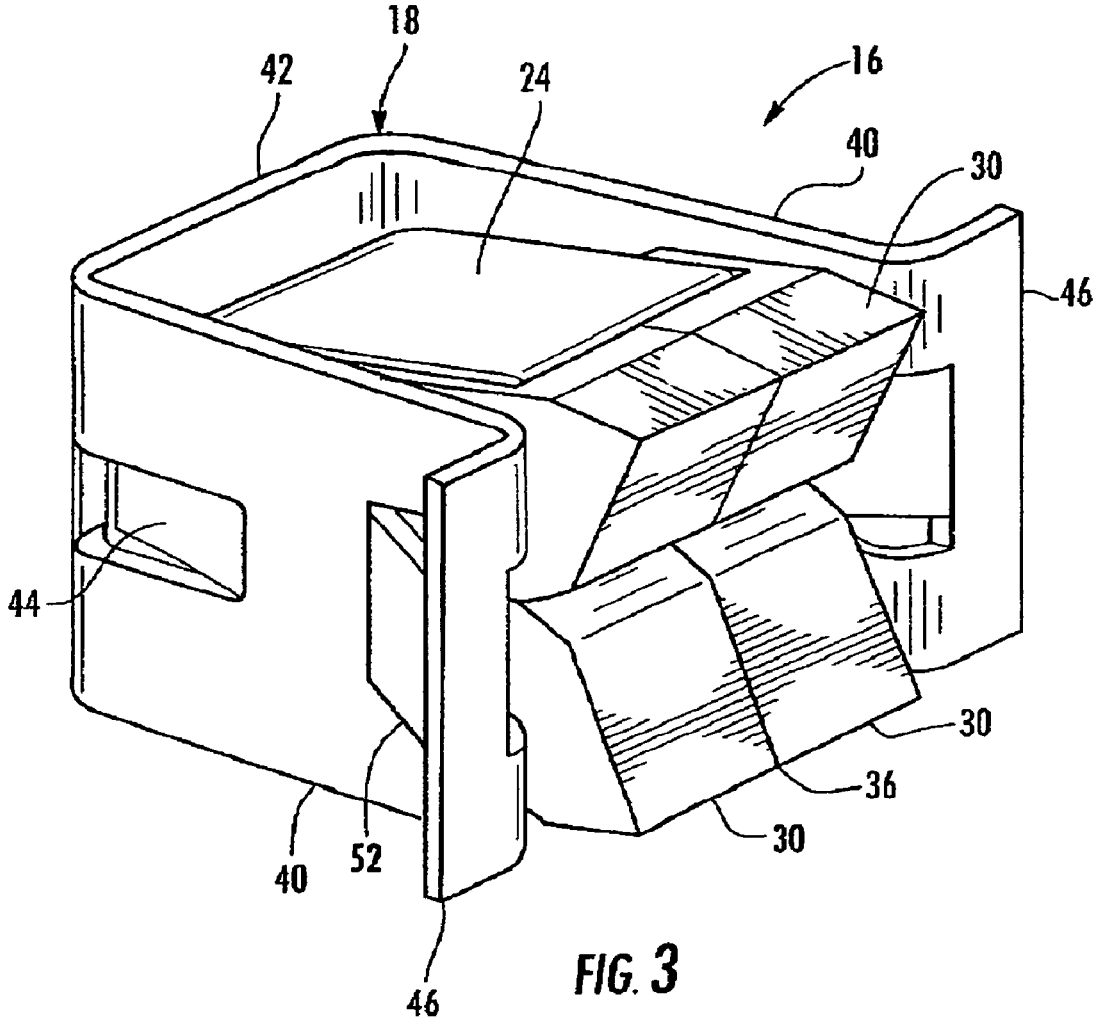
FIG. 3 is an assembled perspective view of an exemplary strike retention subassembly incorporating the anchor latch subassembly of FIG. 2.

As best illustrated in FIG. 2, in the exemplary configuration the anchor latch 20 includes a resilient spring member 22 of generally "U" shaped profile. In the illustrated arrangement, the spring member 22 includes a pair of spring legs 24 extending away from a spring base 25. The spring legs 24 engage opposing bushing structures 26 adapted to engage and retain the bulbous head portion 14 of the strike 12. The spring member 22 may be formed from any suitable resilient material adapted to withstand high temperatures such as may be present in a fire. Spring steel or other metal may be particularly desirable The bushing structures 26 may be formed from any suitable material such as low friction nylon or other polymer adapted to aid in passage of the bulbous head portion 14.

As illustrated, the bushing structures 26 each include an inwardly sloped face converging to form a strike acceptance crevice 29 as best seen in FIG. 2. In this regard, it will be understood that upon engagement between the strike 12 and a surface of the bushing structures 26, the strike 12 is guided into the strike acceptance crevice 29 for insertion between the bushing structures 26. During this insertion, the spring legs 24 with the attached bushing structures 26 are caused to spread apart. Following completion of the insertion, the spring recovery force of the spring legs 24 causes the bushing structures 26 to clamp behind the bulbous head 14 and to retain the strike 12 in place. In the illustrated construction the bushing structures 26 are of a multi-piece construction. Specifically, in the illustrated exemplary construction, the bushing structures 26 are formed from pairs of bushing elements 30 arranged in end to end relation. As best seen through joint reference to FIGS. 2 and 5, the bushing elements 30 may fit about terminal ends 32 of the spring legs 24. By way of example only, and not limitation, in the illustrated arrangement each of the bushing elements includes a profiled slot opening 34 having an geometry adapted to fit in sleeve-like fashion about the terminal ends 32 of the spring legs 24. The slot openings 34 extend partially but not completely across the width and height of the bushing elements 30 so as to substantially cover the outer edges of the spring legs 24. In this regard, the slot openings 34 of adjacent bushing elements 30 are substantially mirror images of one another. Thus, the bushing elements 30 may be pushed together in end to end relation from opposite sides of each of the spring legs 24.

Once the bushing elements 30 are in place about the terminal ends 32 of the spring legs 24, they may then be joined to one another along adjoining interfaces 36 by suitable techniques such as sonic welding, adhesive bonding, and the like.

As will be recognized, once the adjacent bushing elements 30 have been adjoined to one another to form a bushing structure 26, the terminal ends of the spring legs 24 are held in position relative to the overlying bushing elements 30. In the illustrated exemplary construction this secure connection is aided by the curved profile of the terminal ends 32 of the spring legs 24. Specifically, in the exemplary construction, the terminal ends 32 incorporate a reverse bend configuration with a tip projecting generally upwardly towards the spring base 25. As will be appreciated, such a curved profile aids in preventing withdrawal of the spring legs 24 through the slot opening 34.

Figure 4:
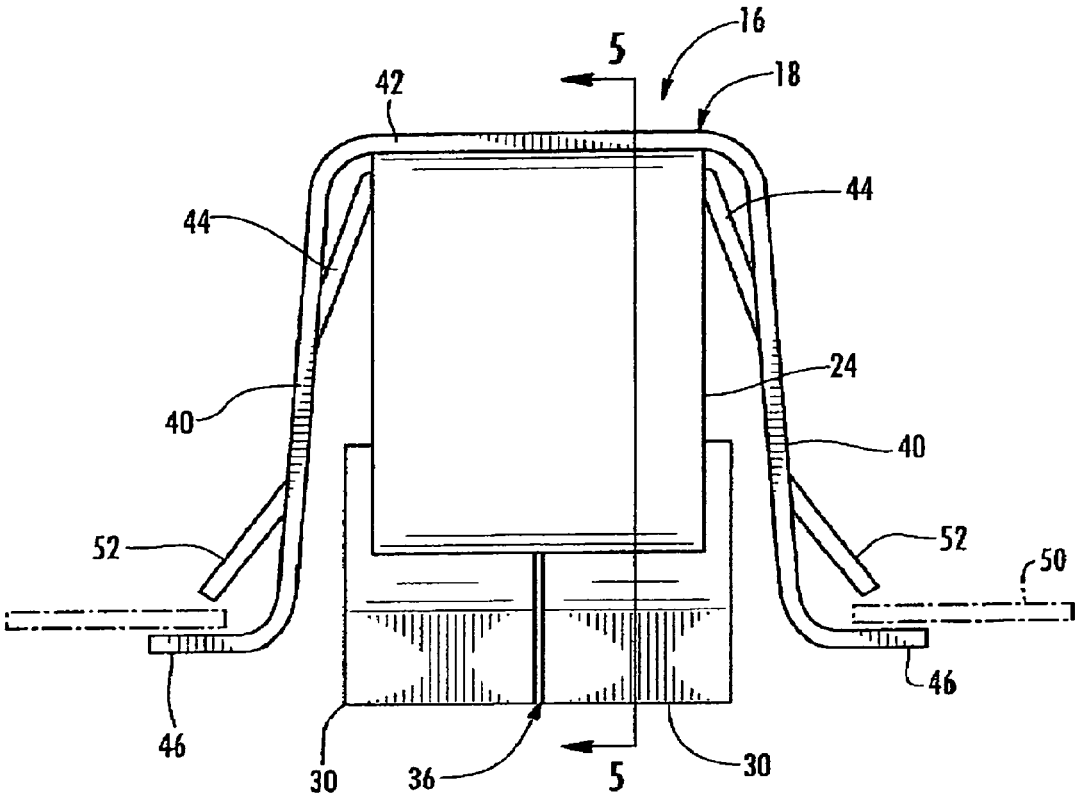
FIG. 4 is a side view illustrating the strike retention subassembly in inserted relation within a support panel.

As best illustrated through joint reference to FIGS. 1, 3, and 4, the anchor latch 20 is held in nested relation within the bracket member 18. In the illustrated arrangement, the bracket member 18 is of a generally "U" shaped geometry including a pair of bracket legs 40 extending away from a bracket base 42. The bracket member 18 may be formed from any suitable material, although spring steel or other metal suitable to withstand high temperature environments may be particularly desirable. In the assembled condition illustrated in FIG. 3, the bracket member 18 and the spring member 22 are disposed in substantially transverse orientation relative to one another. In this orientation the spring legs 24 are located between the bracket legs 40. The spring legs 24 are disposed within planes that are transverse to the bracket legs 40.

Figure 5:
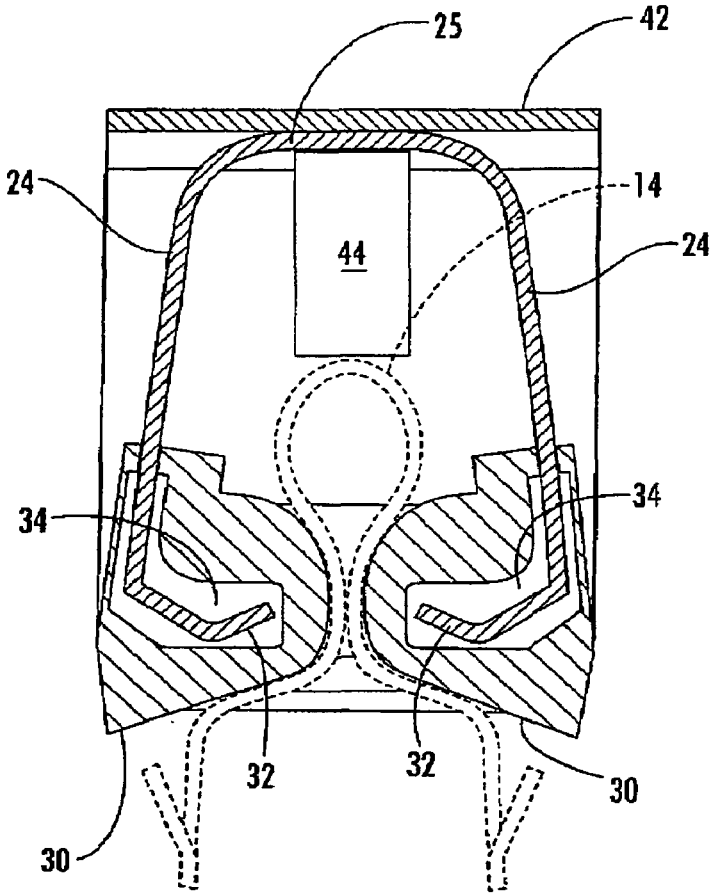
FIG. 5 is a cut-away view taken generally along line 5-5 in FIG. 4.

In the assembled condition, the outer surface of the spring base 25 resides against the inner surface of the bracket base 42. As best illustrated through joint reference to FIGS. 3, 4, and 5, spring retention tab members 44 of resilient character extend in angled relationship upwardly away from interior surfaces of the bracket legs 40 towards the interior surface of the bracket base 42. In the illustrated arrangement, the spring retention tab members 44 are integral with the bracket legs 40. By way of example only, such a construction may be formed by cutting out resilient tabs from the metal or other material forming the bracket member 18 such that the tab members 44 remain connected to the bracket legs along a lower edge. However, it is likewise contemplated that the tab members 44 may be non-integral attached structures. As will be appreciated, upon insertion of the anchor latch 20 into the interior of the bracket member 18, the tab members 44 are pushed outwardly and thereafter spring back into place once the spring base 25 has passed by. In this position as illustrated in FIGS. 4 and 5, the tab members 44 thereafter act to hold the spring base 25 against the underside of the bracket base 42 in a substantially secure relation.

In the exemplary construction, the bracket legs 40 include outwardly flared distal ends 46. In practice, the flared distal ends 46 define blocking surfaces which limit insertion of the assembled strike retention assembly into an access opening within a panel 50 as shown in phantom in FIG. 4. As noted previously, the panel 50 may form a portion of a door or cabinet of an appliance such as a clothes dryer or the like. However, the panel 50 may likewise form a portion of virtually any other enclosure as may be desired.

In the illustrated exemplary construction, the bracket member 18 also includes downwardly extending locking tabs 52 extending away from the bracket legs 40. The locking tabs 52 are of a resilient character and may be formed from metal or other material making up the bracket member 18. The locking tabs 52 flex inwardly as the strike retention assembly 16 is inserted into an access opening within the panel 50. Upon reaching full insertion, the locking tabs 52 thereafter spring back into position behind the panel 50. In this position, the locking tabs 52 block withdrawal of the strike retention assembly 16 through the access opening. As shown, the spacing between the locking tabs 52 and the flared distal ends 46 may be set to be substantially equivalent to the thickness of the panel 50. Such an arrangement may promote stability. As illustrated, the locking tabs 52 may be formed as cut-outs from the material of the bracket member 18. However, it is likewise contemplated that non-integral resilient structures may likewise be utilized if desired.

In operation, the bushing structures 26 formed from the bushing elements 30 act to slidably engage the bulbous head portion 14 of the strike 12 during a latching procedure. As will be appreciated, the spring legs 24 are able to flex outwardly in substantially independent relation to one another. Thus, the anchor latch 20 is able to accommodate the strike 12 even if the strike impacts only one of the bushing structures 26 at a position substantially distant from the strike acceptance crevice 29. Moreover, in the event of a fire, or other high temperature event, the substantially locked relationship will be maintained. In particular, in the event of a high temperature event which melts one or more of the bushing elements 30, the spring legs 24 will nonetheless act to hold the bulbous head portion 14 of the strike in place. In this regard, as best seen in FIG. 5, the terminal ends 32 of the spring legs 24 include reverse bends angling upwardly generally towards the spring base 25. As will be appreciated, in the event that the reduced friction bearing elements 30 have been melted away, the reverse bends of the terminal ends 54 will present a relatively high friction barrier to withdrawal of the bulbous head portion 14. Moreover, the overall engagement anchor assembly 16 is held in place relative to the panel 50 by the heat resistant locking tabs 52 and flared distal ends 46. Accordingly, an enclosure such as a dryer cabinet or the like, will tend to remain closed in the event of a fire. Maintaining such a closed relation may aid in containing the fire within the closed container.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A latch strike retention assembly adapted to accept and retain a latch strike, the latch strike retention assembly comprising:

a bracket member of substantially "U" shaped profile adapted for retention within a panel opening, the bracket member including a bracket base and a pair of substantially opposing bracket legs extending away from the bracket base; and an anchor latch disposed at the interior of the bracket member, the anchor latch including a substantially "U" shaped spring member, the spring member including a first spring leg extending away from a spring base and a second spring leg extending away from the spring base, the first spring leg operatively engaging a first bushing structure, the second spring leg operatively engaging a second bushing structure, the first bushing structure and the second bushing structure disposed in opposing relation to one another and cooperatively defining a strike acceptance crevice having a length dimension extending between the first bushing structure and the second bushing structure, wherein the first spring leg includes a first reverse bend at a terminal end of the first spring leg surrounded by the first bushing structure and the second spring leg includes a second reverse bend at a terminal end of the second spring leg surrounded by the second bushing structure, wherein the terminal end of the first spring leg and the terminal end of the second spring leg each curve inwardly towards the strike acceptance crevice with distal tips projecting back towards the spring base, the anchor latch being secured at an interior portion of the bracket member with the spring member oriented transverse to the bracket member with the length dimension of the strike acceptance crevice oriented transverse to the bracket legs.

2. The latch strike retention assembly as recited in claim 1, wherein the bracket member is formed from metal.

3. The latch strike retention assembly as recited in claim 2, wherein the spring member is formed from metal.

4. The latch strike retention assembly as recited in claim 2, wherein the spring member is formed from spring steel.

5. The latch strike retention assembly as recited in claim 1, wherein at least one of the first bushing structure and the second bushing structure is formed from a polymeric material.

6. The latch strike retention assembly as recited in claim 1, wherein each of the first bushing structure and the second bushing structure includes an angled strike engagement face extending away from the strike acceptance crevice.

7. The latch strike retention assembly as recited in claim 1, wherein each of the first bushing structure and the second bushing structure is formed from a polymeric material and wherein each of the first bushing structure and the second bushing structure includes an angled strike engagement face extending away from the strike acceptance crevice, the strike engagement face of the first bushing structure and the strike engagement face of the second bushing structure converging at the strike acceptance crevice.

8. The latch strike retention assembly as recited in claim 1, wherein the first bushing structure is a multi-piece construction disposed in sleeve fitting relation about the first reverse bend and the second bushing structure is a multi-piece construction disposed in sleeve fitting relation about the second reverse bend.

9. A latch strike retention assembly adapted to accept and retain a latch strike, the latch strike retention assembly comprising:

a bracket member of substantially "U" shaped profile adapted for retention within a panel opening, the bracket member including a bracket base, a first bracket leg extending away from the bracket base and a second bracket leg extending away from the bracket base; and an anchor latch disposed at the interior of the bracket member, the anchor latch including a substantially "U" shaped spring member, the spring member including a first spring leg extending away from a spring base and a second spring leg extending away from the spring base, the first spring leg operatively engaging a first bushing structure, the second spring leg operatively engaging a second bushing structure, the first bushing structure and the second bushing structure disposed in opposing relation to one another and cooperatively defining a strike acceptance crevice having a length dimension extending between the first bushing structure and the second bushing structure, wherein the first spring leg includes a first reverse bend at a terminal end of the first spring leg surrounded by the first bushing structure and the second spring leg includes a second reverse bend at a terminal end of the second spring leg surrounded by the second bushing structure, wherein the terminal end of the first spring leg and the terminal end of the second spring leg each curve inwardly towards the strike acceptance crevice with distal tips projecting back towards the spring base, the first bushing structure comprising a first bushing element and a second bushing element cooperatively surrounding a the terminal end of the first spring leg, the first bushing element and the second bushing element each including a profiled slot opening adapted to slide in sleeve-fitting relation partially about the terminal end of the first spring leg, the profiled slot openings extending partially but not completely across the width and height of the bushing elements, the bushing elements being disposed in end to end relation about the terminal end of the first spring leg in cooperative surrounding relation to the terminal end of the first spring leg with the outer lateral edges of the terminal end of the first spring leg being covered, the anchor latch being secured at an interior portion of the bracket member with the spring member oriented transverse to the bracket member with the spring legs oriented between the bracket legs and with the length dimension of the strike acceptance crevice oriented transverse to the bracket legs.

10. The latch strike retention assembly as recited in claim 9, wherein the first bushing element and the second bushing element are fixedly secured to one another.

11. The latch strike retention assembly as recited in claim 10, wherein the first bushing element and the second bushing element are welded to one another along an adjoining interface extending transverse to the length dimension of the strike acceptance crevice.

12. The latch strike retention assembly as recited in claim 9, wherein the second bushing structure comprises a third bushing element and a fourth bushing element cooperatively surrounding the terminal end of the second spring leg, the third bushing element and the fourth bushing element being disposed in end to end relation about the terminal end of the second spring leg in cooperative surrounding relation to the terminal end of the second spring leg with the outer lateral edges of the terminal end of the second spring leg being covered.

13. The latch strike retention assembly as recited in claim 12, wherein the first bushing element and the second bushing element are welded to one another along a first adjoining interface extending transverse to the length dimension of the strike acceptance crevice and wherein the third bushing element and the fourth bushing element are welded to one another along a second adjoining interface extending transverse to the length dimension of the strike acceptance crevice.

14. The latch strike retention assembly as recited in claim 12, the first bracket leg including a first outwardly flared distal end, the second bracket leg including a second outwardly flared distal end, the first bracket leg including a first inwardly extending resilient spring retention tab projecting in upwardly angled relation away from the first bracket leg generally towards the bracket base and a first outwardly extending resilient locking tab projecting in downwardly angled relation away from the first bracket leg generally towards the first outwardly flared distal end, the second bracket leg including a second inwardly extending resilient spring retention tab projecting in upwardly angled relation away from the second bracket leg generally towards the bracket base and a second outwardly extending resilient locking tab projecting in downwardly angled relation away from the second bracket leg generally towards the second outwardly flared distal end, the anchor latch being secured adjacent an interior surface of the bracket base with the spring base held between the bracket base and the first and second spring retention tabs.

15. A latch strike retention assembly adapted to accept and retain a latch strike, the latch strike retention assembly comprising:

a metallic bracket member of substantially "U" shaped profile adapted for retention within a panel opening, the bracket member including a bracket base, a first bracket leg extending away from the bracket base and a second bracket leg extending away from the bracket base, the first bracket leg including a first outwardly flared distal end, the second bracket leg including a second outwardly flared distal end, the first bracket leg including a first inwardly extending resilient spring retention tab projecting in upwardly angled relation away from the first bracket leg generally towards the bracket base and a first outwardly extending resilient locking tab projecting in downwardly angled relation away from the first bracket leg generally towards the first outwardly flared distal end, the second bracket leg including a second inwardly extending resilient spring retention tab projecting in upwardly angled relation away from the second bracket leg generally towards the bracket base and a second outwardly extending resilient locking tab projecting in downwardly angled relation away from the second bracket leg generally towards the second outwardly flared distal end; and an anchor latch disposed at the interior of the bracket member, the anchor latch including a substantially "U" shaped spring member, the spring member including a first spring leg extending away from a spring base and a second spring leg extending away from the spring base, the first spring leg operatively engaging a first bushing structure, the second spring leg operatively engaging a second bushing structure, the first bushing structure and the second bushing structure disposed in opposing relation to one another and cooperatively defining a strike acceptance crevice having a length dimension extending between the first bushing structure and the second bushing structure, wherein the first spring leg includes a first reverse bend at a terminal end of the first spring leg surrounded by the first bushing structure and the second spring leg includes a second reverse bend at a terminal end of the second spring leg surrounded by the second bushing structure, wherein the terminal end of the first spring leg and the terminal end of the second spring leg each curve inwardly towards the strike acceptance crevice with distal tips projecting back towards the spring base, the first bushing structure comprising a first bushing element and a second bushing element, the first bushing element and the second bushing element being disposed in end to end relation about the terminal end of the first spring leg in cooperative surrounding relation to the terminal end of the first spring leg with the outer lateral edges of the terminal end of the first spring leg being covered, the anchor latch being secured adjacent an interior surface of the bracket base with the spring base held between the bracket base and the first and second spring retention tabs, the spring member being oriented transverse to the bracket member with the spring legs oriented between the bracket legs and with the length dimension of the strike acceptance crevice oriented transverse to the bracket legs.

16. The latch strike retention assembly as recited in claim 15, wherein each of the first inwardly extending resilient spring retention tab and the second inwardly extending resilient spring retention tab is integral with the bracket member.

17. The latch strike retention assembly as recited in claim 15, wherein each of the first outwardly extending resilient locking tab and the second outwardly extending resilient locking tab is integral with the bracket member.

* * * * *